US006454145B1

(12) United States Patent
Russ

(10) Patent No.: US 6,454,145 B1
(45) Date of Patent: Sep. 24, 2002

(54) HANGER FOR A FLAK VEST

(76) Inventor: Charles S. Russ, 5335 Railview Ct., Apt. 150, Shelby Township, MI (US) 48316-5700

( * ) Notice: Subject to any disclaimer, the term of this patent is extended or adjusted under 35 U.S.C. 154(b) by 0 days.

(21) Appl. No.: 09/721,143

(22) Filed: Nov. 22, 2000

(51) Int. Cl.[7] ..... A41D 27/22
(52) U.S. Cl. ..... 223/85; 223/87; 223/88
(58) Field of Search ..... 223/85, 94, 89, 223/87

(56) References Cited

U.S. PATENT DOCUMENTS

| | | | | |
|---|---|---|---|---|
| 958,366 A | | 5/1910 | Clausen | |
| 1,052,426 A | | 2/1913 | Ringler | |
| 3,531,028 A | | 9/1970 | Vazquez | |
| 4,932,571 A | | 6/1990 | Blanchard | |
| 4,978,043 A | | 12/1990 | Uke | |
| 5,022,569 A | | 6/1991 | Beaulieu | |
| 5,480,075 A | * | 1/1996 | Robinson | 223/88 |
| 5,516,013 A | | 5/1996 | Gouldson et al. | |
| 5,603,438 A | * | 2/1997 | Jugan | 223/89 |
| 5,664,709 A | | 9/1997 | Graham | |
| 5,927,571 A | * | 7/1999 | Richards | 223/88 |
| 6,076,714 A | | 6/2000 | Wyenn | |
| 6,105,835 A | * | 8/2000 | Hatakeyama | 223/88 |

* cited by examiner

*Primary Examiner*—Rodney M. Lindsey
*Assistant Examiner*—James G Smith
(74) *Attorney, Agent, or Firm*—Vanophem & Vanophem, P.C.

(57) ABSTRACT

A hanger for supporting and drying a flak vest, the hanger including an upper support, a lower support, and a vertical support connected therebetween. The upper support includes a cross-member portion and a hook portion extending upwardly therefrom. The vertical support includes an upper end connected to the cross-member, opposite the hook portion. The vertical support extends downwardly to an adjustable collar portion, and further downwardly terminating in a lower end. The lower end of the vertical support couples to the lower support at a base portion thereof. Retainers extend upwardly from the base portion on opposite sides of the vertical support so as to define retaining channels between the retainers and vertical support.

10 Claims, 2 Drawing Sheets

HANGER FOR A FLAK VEST

CROSS-REFERENCES TO RELATED APPLICATIONS

Not applicable.

FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

The present invention generally relates to garment hangers. More specifically, this invention relates to a garment hanger for storing and drying a flak vest in a fully supportive manner such that inside surfaces of the flak vest dry and the flak vest does not stretch or warp.

2. Description of the Related Art

Garment hangers are widely used throughout the world for storing and drying a diverse variety of garments. Until now, however, garment hangers have not been designed specifically for properly supporting and drying a flak vest. Nonetheless, some garment hangers have been specifically designed for other garments such as diving wetsuits and hockey equipment.

For example, U.S. Pat. No. 4,978,043 to Uke teaches use of a hanger for drying and storage of wetsuits and wetsuit accessories. Uke discloses a plastic hanger with an "I-beam" cross section having a hook with an elongated neck and a crossbar coupled to the elongated neck opposite the hook. A pair of outer fingers extend upwardly from opposite ends of the crossbar, and a pair of inner fingers disposed inboard of the pair of outer fingers also extend upwardly from the crossbar. A lower arm portion extends from one end of the crossbar downwardly therefrom, bends, and extends roughly parallel with respect to the crossbar. The inner fingers are used to support wetsuit gloves, the outer fingers are used to support wetsuit boots, and the lower arm is used to support a wetsuit hood.

In another example, U.S. Pat. No. 6,076,714 to Wyenn teaches use of a hockey hanger to hang hockey gear in a spaced apart manner to permit air drying thereof for preventing build up of mold and mildew thereon. The hockey hanger includes a bungee cord having a knot tied in the middle thereof to form a hanging loop for suspending the hanger. Accordingly, a pair of cord sections hang downwardly from the loop and each includes a series of clamps knotted thereto in spaced apart increments.

Unfortunately, neither of the above-mentioned prior art devices are specifically suited for properly supporting a flak vest, nor is a conventional wire hanger. Typically, a flak vest includes a front panel, a rear panel, and a pair of elastic shoulder straps connecting the panels together at shoulder portions thereof. Although the panels are typically made from comparatively lightweight material, the panels are too heavy for use with a conventional wire hanger. Nonetheless, flak vest users usually take the flak vest off their body and immediately hang the flak vest over a conventional wire hanger such that only the elastic shoulder straps hang from the hanger, leaving the panels sagging therefrom. Thus, due to the weight of the panels of the flak vest, the elastic tends to stretch beyond its memory and the shoulder portions of each of the panels tend to curl and deform under the strain of the hanging weight of the panels. Furthermore, the inside surfaces of each of the panels tend to come into contact with each other when the flak vest sags from the conventional wire hanger. Clearly, such a condition prevents the inside of the flak vest from drying properly and therefore leads to build up of undesirable wetness and body odor inside the flak vest.

From the above, it can be appreciated that conventional wire hangers and the special purpose garment hangers of the prior art are not fully optimized for use with flak vests. Therefore, what is needed is a flak vest hanger that is capable of comprehensively supporting a flak vest not only by the elastic shoulder straps, but also below the front and rear panels so as to prevent stretching the elastic shoulder straps and to promote separation of the panels for airflow therebetween.

SUMMARY OF THE INVENTION

According to the preferred embodiment of the present invention, there is provided a hanger for a flak vest, wherein the hanger includes an upper support, a lower support, and an adjustable vertical support connected therebetween. The upper support includes a hook portion connected to and extending upwardly from a cross-member portion. The cross-member portion connects to an upper end of the vertical support, such that the vertical support is disposed opposite the hook portion. The vertical support is a telescoping member that extends downwardly to an adjustable collar portion. From the adjustable collar portion, the vertical support extends further downwardly, terminating in a lower end. The lower end of the vertical support couples to the lower support at a base portion of the lower support. The lower support includes retainers extending upwardly from the base portion on opposite sides of the vertical support so as to define retaining channels between the retainers and vertical support. The hanger provides support of the flak vest from a pair of elastic shoulder straps on the flak vest and further provides support underneath bottom portions of front and rear panels of the flak vest to prevent stretching and deforming of the elastic shoulder straps. The hanger is also effective to keep the front and rear panels of the flak vest separated to promote air-drying of the flak vest.

According to an alternative embodiment of the present invention, there is provided a hanger for a flak vest having a front and rear panel with upper and lower ends thereon. Each lower end terminates in a J-shaped flange portion defining a retaining channel. A hinge feature is formed in the upper end of each panel such that the front and rear panels are suspended from the hinge feature about a pivot pin to enable the J-shaped flange portions to be oriented in back-to-back fashion. A hook portion is pivotably mounted about the pivot pin and includes a slot therein proximate the pivot pin, and a hook distal the pivot pin. A handle portion for carrying the hanger is accessible when the hook is pivoted downward and the hook portion is accessible for hanging the hanger when the hook portion is pivoted upward. The bottom portions of the front and rear panels may be spread apart so as to define a base for supporting the hanger upright on a flat surface.

It is an object of the present invention to provide a hanger for storing and drying a flak vest thereon in a fully supportive manner so that the flak vest does not stretch or warp and so that inside surfaces of the flak vest can properly dry.

It is another object to provide a hanger for a flak vest that is not only capable of supporting the flak vest by its elastic shoulder straps, but is also capable of supporting the flak vest underneath bottom edges of front and rear panels of the flak vest so as to prevent overly stretching the elastic shoulder straps of the flak vest.

It is a still another object to fabricate the hanger from relatively inexpensive and easy to assemble "off-the-shelf" materials such as standard piping and fittings, and readily available plastic stock.

It is yet another object to provide a hanger for a flak vest that is adjustable to accommodate a wide variety of flak vest sizes.

It is a further object to provide a flak vest hanger that can be easily disassembled into smaller sub-assemblies for compact storing and shipment.

It is still a further object to provide a hanger for a flak vest that is capable of keeping the panels of the flak vest separated so as to promote air drying therebetween.

It is yet a further object to provide a hanger for a flak vest that fully supports the flak vest as the hanger is hung from a hanger rod or rested upright on a flat surface.

These objects and other features, aspects, and advantages of this invention will be more apparent after a reading of the following detailed description, appended claims, and accompanying drawings.

DETAILED DESCRIPTION OF THE PREFERRED EMBODIMENT

Figure 1:
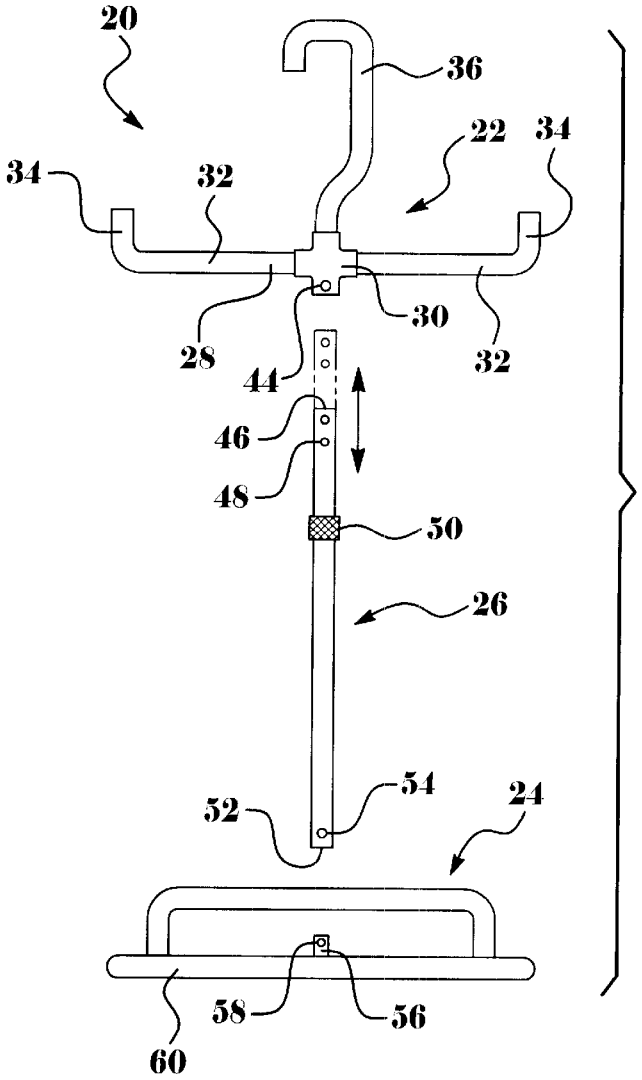
FIG. 1 is an exploded view of a flak vest hanger according to the preferred embodiment of the present invention.

Referring now in detail to the Figures, there is shown in FIG. 1*a* hanger 20 according to a preferred embodiment of the present invention. The hanger 20 generally includes an upper support 22, a lower support 24, and a vertical support 26 connected therebetween. The upper and lower supports 22 and 24 are preferably composed of standard pipe and pipe fittings including 45° and 90° elbow fittings, cap fittings, tee fittings, and lengths of pipe, that are composed of standard material such as copper, PVC plastic, or aluminum. Likewise, the vertical support 26 is preferably made from a standard telescoping aluminum rod. The hanger 20 is preferably made by assembling and sweating ½" copper pipe fittings for the upper and lower supports 22 and 24, as is well known to a person of ordinary skill in the art. The material selection recited above, however, is only preferred and the invention is not to be limited only thereto.

The upper support 22 includes a cross-member portion 28 constructed centrally from a cross fitting 30. Horizontal arms 32 extend oppositely outwardly from the cross fitting 30 and terminate in upwardly turned ends 34. A hook portion 36 extends upwardly from the cross fitting 30 for hanging the hanger 20 over a hanger rod or the like. Opposite the hook portion 36 on the cross fitting 30, a snap hole 44 is formed therein.

The vertical support 26 includes an upper end 46 that fits up into the cross fitting 30 opposite the hook portion 36. The vertical support 26 has an upper snap button 48 disposed thereon for interengagement with the snap hole 44 in the cross fitting 30 of the upper support 22. As with the material selected for the upper and lower supports 22 and 24, the vertical support 26 is preferably an off-the-shelf item such as a twist lock telescoping rod. Such a telescoping rod can be found on a "REDDI-MEASURE" counter, model number 1987-015S available from Reddington Counters, Inc. Accordingly, the vertical support 26 is extendible by loosening a twist-lock collar portion 50, extending the telescoping rod, and tightening the collar portion 50 with the rod in the desired position. The telescoping rod has a grooved design such that upper and lower sections of the telescoping rod will not rotate with respect to each other. The telescoping function is particularly advantageous so that the hanger 20 will accommodate flak vests of all sizes. The vertical support 26 further includes a lower end 52 with a lower snap button 54 disposed thereon.

Figure 3:
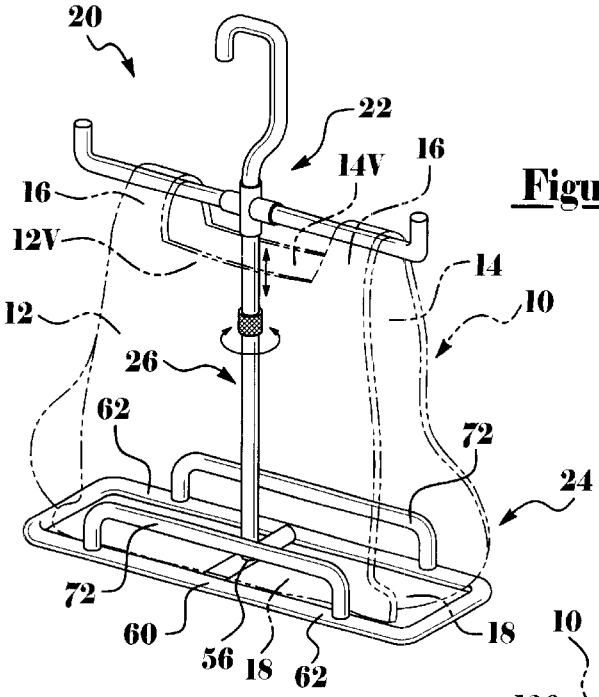
FIG. 3 is a perspective view of the flak vest hanger of FIG. 1 illustrating a flak vest in phantom.

The lower support 24 includes a central tee fitting 56 that accepts the lower end 52 of the vertical support 26 therein. The central tee fitting 56 has a snap hole 58 therein for interengagement with the lower snap button 54 on the lower end 52 of the vertical support 26. As best shown in FIG. 3, the central tee fitting 56 serves as a central cross-member of a rectangle-shaped base portion 60 of the lower support 24 by spanning opposite base rails 62 of the base portion 60. Retaining rails 72 extend upwardly from and run parallel to the base rails 62 and thereby define retaining channels on opposite sides of the vertical support 26 between each retaining rail 72 and the vertical support 26.

Referring again to FIG. 1, the hanger 20 can be easily disassembled into three smaller subassemblies by unlocking the upper and lower snap buttons 48 and 54 of the vertical support 26 from the snap holes 44 and 58 of the upper and lower support 22 and 24. This is advantageous for storing the hanger 20 when it is not in use or for compact shipping of the hanger 20 to a customer. Similarly, the hanger 20 can be adjusted in a vertical direction by telescoping the vertical support 26 either up or down.

Figure 2:
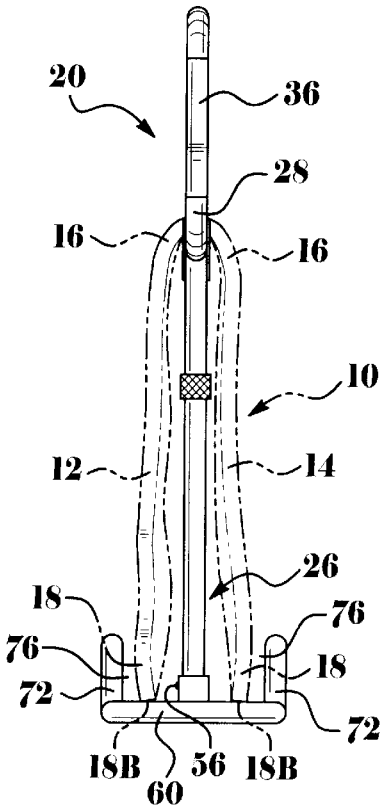
FIG. 2 is a side view of the flak vest hanger of FIG. 1 illustrating a flak vest in phantom.

As illustrated in FIGS. 2 and 3, a flak vest 10 is hung over the hanger in a fully supportive fashion. As best shown in FIG. 3, the flak vest 10 includes front and rear panels 12 and 14 connected at upper ends 12 V and 14 V thereof by elastic shoulder straps 16. As best shown in FIG. 2, the flak vest 10 is placed on the hanger 20 such that the elastic shoulder straps 16 are hung over the cross-member portion 28 and the bottom portions 18 of the front and rear panels 12 and 14 locate in retaining channels 76 defined between the retaining rails 72 and the vertical support 26. Each panel 12 and 14 is disposed on an opposite side of the vertical support 26 such that the vertical support 26 keeps the insides of the panels 12 and 14 separated to permit air to flow therebetween for drying the inside of the flak vest 10. Accordingly, bottom edges 18B of the front and rear panels 12 and 14 are supported atop the crossmember of the base portion 60 defined by the central tee fitting 56.

The vertical support 26 can be adjusted in length so that when the elastic shoulder straps 16 are hung over the cross-member portion 28 they stretch only slightly to permit the bottom edges 18B of the front and rear panels 12 and 14 to make contact with the cross-member defined by the central tee fitting 56. The hanger 20 may either be rested on a flat surface by laying the base portion 60 on the flat surface, or the hanger 20 may be hung over a rod by its hook portion 36.

In any case, the front and rear panels 12 and 14 are separated by the vertical support 26, and the flak vest 10 is properly supported at its upper ends 12 V and 14 V by the elastic shoulder straps 16 and at its bottom portions 18 by the base portion 60 of the hanger 20. As a result the elastic shoulder straps 16 will not stretch beyond memory since the hanging weight of the flak vest 10 is prevented from stretching the elastic shoulder straps 16 out of adjustment and out of shape, since the bottom edges 18B of the panels 12 and 14 are supported atop the cross-member of the base portion 60. This will assist in maintaining the original shape of the flak vest 10 without any warping or deforming, and will provide for a more comfortable fit for each use of the flak vest 10. The present invention also permits the flak vest 10 to dry faster and more completely since air is free to flow through the inside of the flak vest 10 between the separated front and rear panels 12 and 14. Allowing the flak vest 10 to dry completely between uses will assist in maintaining the flak vest 10 in its original condition and in extending the life of the flak vest 10.

Figure 4:
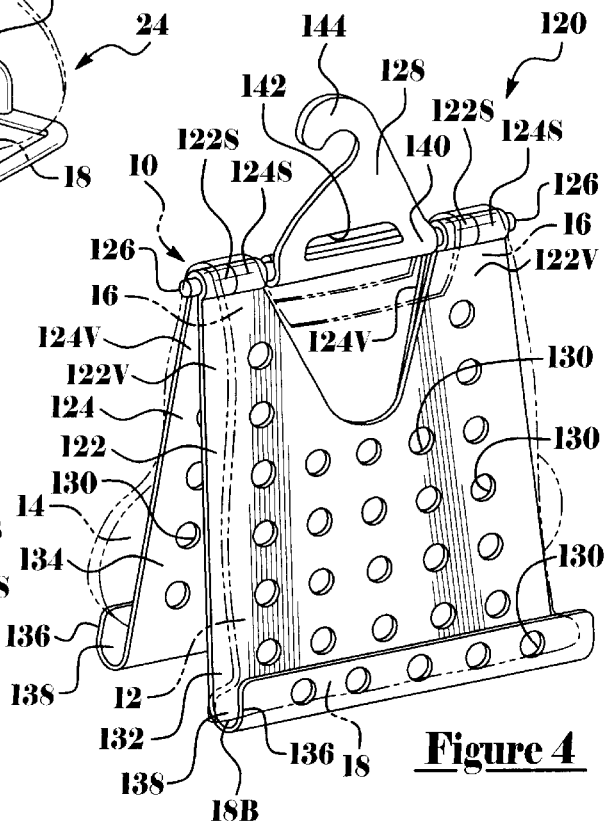
FIG. 4 is a perspective view of a flak vest hanger according to an alternative embodiment of the present invention illustrating a flak vest in phantom.
Figure 5:
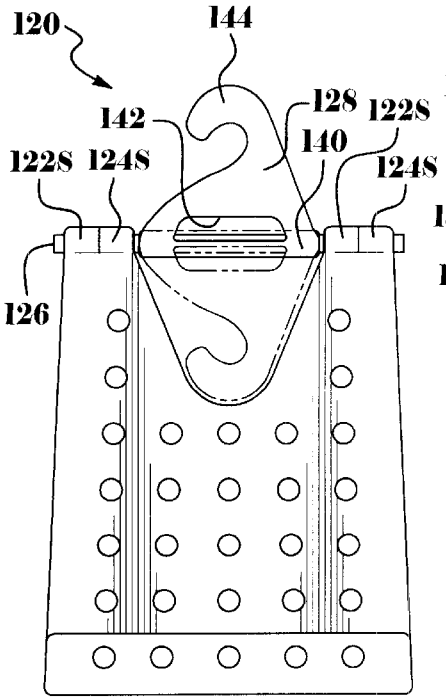
FIG. 5 is a front view of the flak vest hanger of FIG. 4.

FIGS. 4 and 5 illustrate a flak vest hanger 120 according to an alternative embodiment of the present invention. As shown in FIG. 4, the flak vest hanger 120 is composed of identical front and rear panels 122 and 124 hinged at respective upper ends 122 V and 124 V thereof by a pivot pin 126, and a hook portion 128 pivotably mounted about the pivot pin 126. The front and rear panels 122 and 124 and the hook portion 128 are fabricated from ¼" thick flat plastic stock.

Each of the front and rear panels 122 and 124 is cut from plastic stock and an array of vent holes 130 is drilled therethrough for ventilation of the flak vest 10. Each upper end includes opposed shoulder portions 122S and 124S that are formed by heating and bending the plastic into the desired hinge shape as shown. Thus, the front panel 122 interlocks with the rear panel 124, in a manner similar to a common door hinge, as shown. Bottom ends 132 and 134 of the panels 122 and 124 are likewise formed by heating and bending to form a J-shaped flange 136 that in turn defines a retaining channel 138 between each J-shaped flange 136 and the front surface of each panel 122 and 124. The front and rear panels 122 and 124 are positioned with respect to each other such that the J-shaped flanges 136 are in back-to-back orientation.

As shown in FIGS. 4 and 5, the hook portion 128 is cut from plastic stock to produce the shape as shown, and includes a hinge portion 140 that is formed by heating and bending. A slot 142 is disposed proximate the hinge portion 140 to provide a handle for carrying the hanger 120. Opposite the slot 142, a hook 144 is disposed distal the hinge portion 140 to provide a way to hang the hanger 120 from an object, such as a hanger rod or locker hook. The pivot pin 126, that is formed from a suitable material such as a copper pipe or solid rod, links the shoulder portions 122S and 124S of the panels 122 and 124 together as shown, and the hinge portion 140 of the hook portion 128 mounts about the pivot pin 126.

Referring now to FIG. 4, the hook portion 128 is free to pivot about the pivot pin 126 such that it may be used as a hook as shown in an upright orientation for hanging on a hanger rod, or the slot 142 may be used as a handle when the hook portion 128 is pivoted in a downward orientation. The front and rear panels 122 and 124 pivot about their respective shoulder portions 122S and 124S so that the front panel 122 separates from the rear panel 124 at the bottom portions 132 and 134 thereof so as to provide a stable base for resting the hanger 120 on the ground. The elastic shoulder straps 16 of the flak vest 10 are slung over the front and rear panels 122 and 124 at their respective shoulder portions 122S and 124S thereof. The front and rear panels 12 and 14 of the flak vest 10 correspondingly rest flat against the front and rear panels 122 and 124 of the hanger 120 such that the bottom portions 18 of the flak vest 10 bottom out and are therefore supported in their respective retaining channel 138 of the front and rear panels 122 and 124. Accordingly, the bottom edges 18B of the flak vest 10 are supported by the J-shaped flanges 136 so that the flak vest 10 will stay on the hanger 120 and will not sag and stretch the elastic shoulder straps 16 beyond their memory.

While the present invention has been described in terms of a preferred embodiment, it is apparent that other forms could be adopted by one skilled in the art. Those skilled in the art will appreciate that other applications, including uses other than with flak vests, are possible with this invention. Accordingly, the scope of the present invention is to be limited only by the following claims.

What is claimed is:

1. A hanger for a flak vest, said flak vest having front and rear panels and a pair of elastic shoulder straps connected therebetween, said front and rear panels terminating in bottom portions, said hanger comprising:

a hook portion;

means for supporting said pair of elastic shoulder straps, said means for supporting being connected to said hook portion;

means for separating said front and rear panels of said flak vest, said means for separating extending downwardly from said means for supporting; and means for retaining said bottom portions of said flak vest to prevent said bottom portions from hanging freely beyond said hanger, said means for retaining connected to said means for separating;

whereby said hanger is effective to support said flak vest from said pair of elastic shoulder straps and underneath said bottom portions of said front and rear panels to prevent stretching and deforming of said flak vest, and is further effective to separate said front and rear panels to promote air drying of said flak vest.

2. A Hanger comprising:

an upper support comprising:

a hook portion; and a cross-member portion coupled to said hook portion;

a vertical support having a lower end and an upper end, said upper end being coupled to said cross-member portion opposite said hook portion; and a lower support coupled to said lower end of said vertical support, said lower support comprising:

a base portion; and means for retaining extending upwardly from said base portion on opposite sides thereof, said means for retaining defining channels between said means for retaining and said vertical support.

3. The hanger as claimed in claim 2, wherein said upper support is composed of standard pipe components, said cross-member portion being comprised of a cross fitting having a snap hole therein.

4. The hanger as claimed in claim 3, wherein said vertical support comprises a telescoping shaft having an upper snap button disposed proximate said upper end for interlocking with said snap hole in said cross fitting of said cross-member portion.

5. The hanger as claimed in claim 4, wherein said lower support is composed of standard pipe components, said base portion has a tee fitting provided with a snap hole therein, and said telescoping shaft has a lower snap button proximate said lower end for interlocking with said snap hole in said tee fitting.

6. The hanger as claimed in claim 5, wherein said hanger supports a flak vest having front and rear panels and a pair of elastic shoulder straps connected therebetween, said front and rear panels terminating in bottom portions, such that said elastic shoulder straps hang over said cross-member portion and said front and rear panels hang downwardly on opposite sides of said telescoping shaft so that said bottom portions of said front and rear panels respectively locate within said channels and are supported by said base portion, whereby said hanger is adapted to be hung by said hook portion and is alternatively adapted to be supported upright from said base portion.

7. A hanger comprising:

a front panel having an upper end and a lower end, said lower end terminating in a J-shaped flange portion defining a retaining channel;

a rear panel having an upper end and a lower end, said lower end terminating in a J-shaped flange portion defining a retaining channel;

means for hinging said upper ends of said front and rear panels such that said front and rear panels suspend from said means for hinging such that said J-shaped flange portions are oriented in back-to-back fashion; and a hook portion pivotably mounted about said means for hinging, said hook portion having a slot proximate said means for hinging and a hook distal from said means for hinging;

whereby said slot is accessible for carrying said hanger when said hook portion is pivoted downward, said hook is accessible for hanging said hanger by said hook portion when said hook portion is pivoted upward, and said bottom portions of said front and rear panels may be spread apart so as to define a base for supporting said hanger upright on a flat surface.

8. The hanger as claimed in claim 7, wherein each of said front and rear panels comprise an array of vent holes therethrough.

9. The hanger as claimed in claim 7, wherein said hook portion said front and rear panels are composed of plastic.

10. The hanger as claimed in claim 7, wherein said hanger supports a flak vest having front and rear panels and a pair of elastic shoulder straps connected therebetween, said front and rear panels terminating in bottom portions, such that said elastic shoulder straps hang over said upper ends of said front and rear panels and further such that said front and rear panels of said flak vest hang downwardly over opposite panels of said hanger so that said bottom portions of said front and rear panels of said flak vest locate within said respective retaining channels and are supported therein, whereby said hanger is adapted to be hung by said hook portion and is alternatively adapted to be supported upright from said J-shaped flange portions.

* * * * *

UNITED STATES PATENT AND TRADEMARK OFFICE

CERTIFICATE OF CORRECTION

PATENT NO. : 6,454,145 B1
DATED : September 24, 2002
INVENTOR(S) : Charles S. Russ It is certified that error appears in the above-identified patent and that said Letters Patent is hereby corrected as shown below:

Title page,
Item [74], kindly delete "Vanophem & Vanophem, P.C." and insert
-- VanOphem & VanOphem, P.C. --.

Column 4,
Line 43, after "hanger" kindly insert -- 20 --.

Column 6,
Line 43, kindly delete "Hanger" and insert -- hanger --.

Signed and Sealed this

Fifteenth Day of April, 2003

JAMES E. ROGAN
*Director of the United States Patent and Trademark Office*